US005956869A

United States Patent [19]

Kim

[11] Patent Number: 5,956,869

[45] Date of Patent: Sep. 28, 1999

[54] SHOE SOLE CONSTRUCTION WITH MESH LINER FOR MID-SOLE CAVITY

[75] Inventor: Nam Kook Kim, Pusan, Rep. of Korea

[73] Assignee: Energaire Corporation, Cheyenne, Wyo.

[21] Appl. No.: 09/035,806

[22] Filed: Mar. 6, 1998

[51] Int. Cl.[6] ..... A43B 13/20; A43B 13/18

[52] U.S. Cl. ..... 36/29; 36/28; 36/30 R

[58] Field of Search ..... 36/28, 29, 30 R, 36/35 R, 35 B, 3 R, 3 B

[56] References Cited

U.S. PATENT DOCUMENTS

| | | | |
|---|---|---|---|
| 3,225,463 | 12/1965 | Burnham | 36/29 |
| 3,533,171 | 10/1970 | Motoki | 36/29 |
| 4,358,902 | 11/1982 | Cole et al. . | |
| 4,577,417 | 3/1986 | Cole . | |
| 4,999,931 | 3/1991 | Vermeulen | 36/29 |
| 5,042,175 | 8/1991 | Ronen et al. | 36/28 |
| 5,044,096 | 9/1991 | Polegato | 36/3 |
| 5,195,254 | 3/1993 | Tyng | 36/3 R |
| 5,280,680 | 1/1994 | Burke et al. | 36/28 |
| 5,524,364 | 6/1996 | Cole et al. . | |
| 5,545,463 | 8/1996 | Schmidt et al. . | |
| 5,664,341 | 9/1997 | Schmidt et al. | 36/28 |
| 5,675,914 | 10/1997 | Cintron | 36/3 B |
| 5,678,328 | 10/1997 | Schmidt et al. . | |
| 5,842,291 | 12/1998 | Schmidt et al. | 36/29 |

*Primary Examiner*—Paul T. Sewell
*Assistant Examiner*—J. Mohandesi
*Attorney, Agent, or Firm*—Emrich & Dithmar

[57] ABSTRACT

A shoe sole and heel construction includes a midsole having a cavity formation therein opening at an outsole-facing surface thereof and lined with a thin perforated liner sheet. The cavity formation may include metatarsal and heel cavities and a restricted recess extending therebetween. The liner sheet covers not only the cavity walls but also portions of the outsole-facing surface immediately surrounding the cavity formation. An outsole is hermetically attached to the outsole-facing surface for closing the cavity formation to form a chamber formation with air at atmospheric pressure trapped therein. The outsole may also have a cavity formation therein which cooperates with the midsole cavity formation to define the chamber formation, and the outsole cavity formation may be congruent with the midsole cavity formation. The midsole is formed by adhesively securing the liner sheet to a body of midsole material and then compression molding the body and liner sheet to deform them into the cavity-containing midsole.

17 Claims, 3 Drawing Sheets

SHOE SOLE CONSTRUCTION WITH MESH LINER FOR MID-SOLE CAVITY

BACKGROUND OF THE INVENTION

1. Field of the Invention

The present invention relates to shoe sole and heel constructions and, in particular, to such constructions with fluid-filled cavities for providing cushioning and forward thrust.

2. Description of the Prior Art

Various types of shoe sole and heel constructions having fluid-containing cavities have heretofore been provided, such constructions being disclosed, for example, in U.S. Pat. Nos. 5,678,328, 5,545,463 and 5,524,364. The present invention is an improvement of a construction disclosed in U.S. Pat. Nos. 5,678,328 and 5,545,463 which includes fluid-containing chambers or compartments which are formed, at least in part, by cavities in a midsole hermetically sealed to an outsole. Each midsole cavity may cooperate with a like outsole cavity to form the associated chamber. While such arrangements generally work well in terms of cushioning the user's foot and providing forward thrust during walking, the midsole cavities may cause discomfort to a user's foot, particularly in the case of relatively thin midsoles. Furthermore, the pressure exerted on the fluid-filled chambers by a user's foot in normal use can create regions of localized very high pressure, at least momentarily, which can cause some leakage of fluid, either from the seams between the midsole and the outsole members or through the midsole itself, which is generally formed of a somewhat porous material and, as was indicated above, may be relatively thin.

SUMMARY OF THE INVENTION

It is a general object of the invention to provide an improved shoe sole and heel construction which avoids the disadvantages of prior constructions while affording additional structural and operating advantages.

An important feature of the invention is the provision of a shoe sole and heel construction of the type which has a fluid-filled cavity formed in a midsole and which minimizes discomfort to a user's foot.

In connection with the foregoing feature, another feature of the invention is the provision of a shoe sole and heel construction of the type set forth, which minimizes leakage of fluid from the cavity.

In connection with the foregoing features, a further feature of the invention is the provision of a shoe sole and heel construction of the type set forth which tends to more evenly distribute forces applied by a user's foot.

Still another feature of the invention is the provision of a shoe sole and heel construction of the type set forth which is of relatively simple and economical construction.

Yet another feature of the invention is the provision of a method for making a shoe sole and heel construction of the type set forth.

Certain ones of these and other features of the invention may be attained by providing a shoe sole and heel construction comprising: an outsole having interior and exterior surfaces, a midsole having an outsole-facing surface and a foot-facing surface, the midsole having a cavity formation therein opening at the outsole-facing surface and defining cavity wall surfaces, a liner sheet covering the cavity wall surfaces and a portion of the outsole-facing surface immediately adjacent to the cavity formation, means securing the outsole-facing surface of the midsole to the interior surface of the outsole in substantially fluid-tight manner so that the outsole cooperates with the cavity formation to define a substantially fluid-tight chamber formation, and fluid confined in the chamber formation.

Other features of the invention may be attained by providing a shoe sole and heel construction of the type set forth, wherein the chamber formation is formed in part by a midsole cavity and in part by an outsole cavity.

Other features of the invention may be attained by providing a method of forming a shoe sole and heel construction comprising: providing a body of porous, compressible and moldable plastic material generally in the shape of a shoe sole and heel and having opposed substantially flat surfaces, covering at least a portion of one of the surfaces with a thin sheet of liner material, and compression molding the body and liner material so as to compress the body and liner material together and deform them to form a lined cavity in the body opening at the one of the surfaces.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
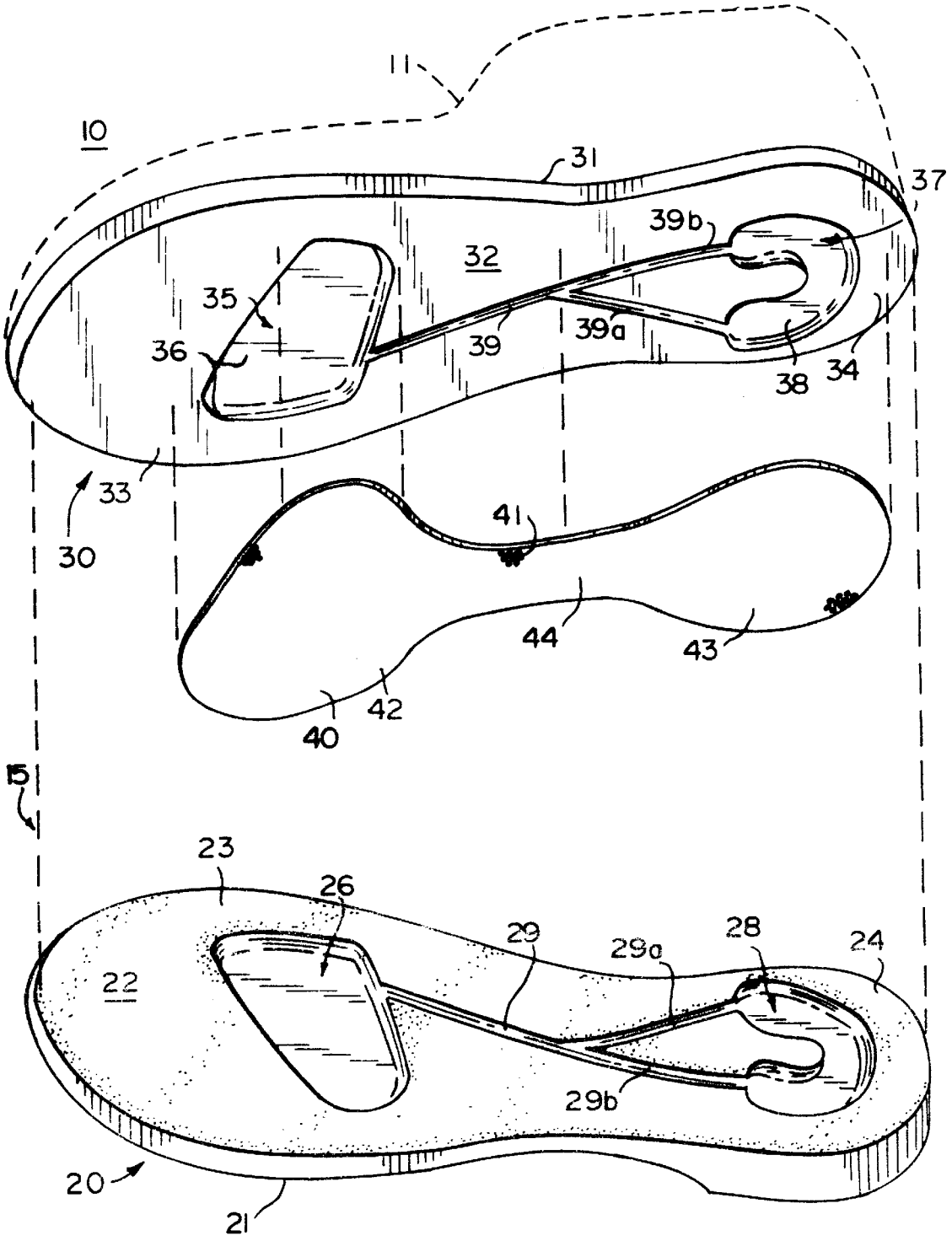
FIG. 1 is an exploded perspective view of a shoe sole and heel construction in accordance with the present invention, shown associated with a shoe upper illustrated in phantom.
Figure 2:
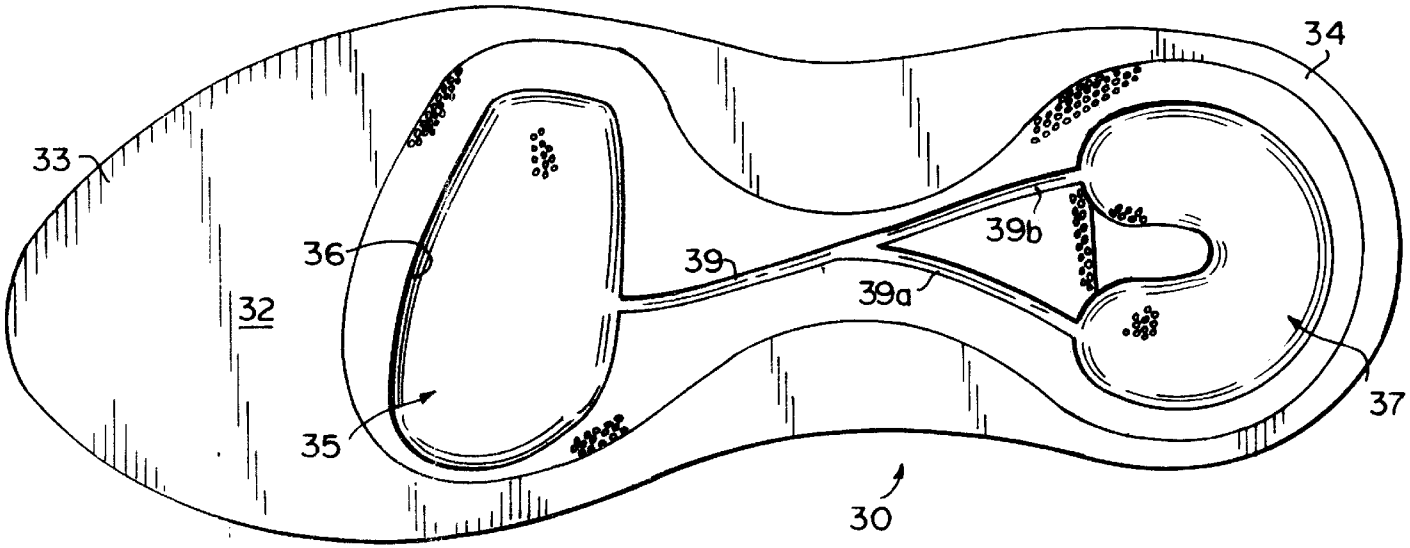
FIG. 2 is an enlarged bottom plan view of the assembled midsole and liner sheet of the shoe sole and heel construction of FIG. 1.
Figure 3:
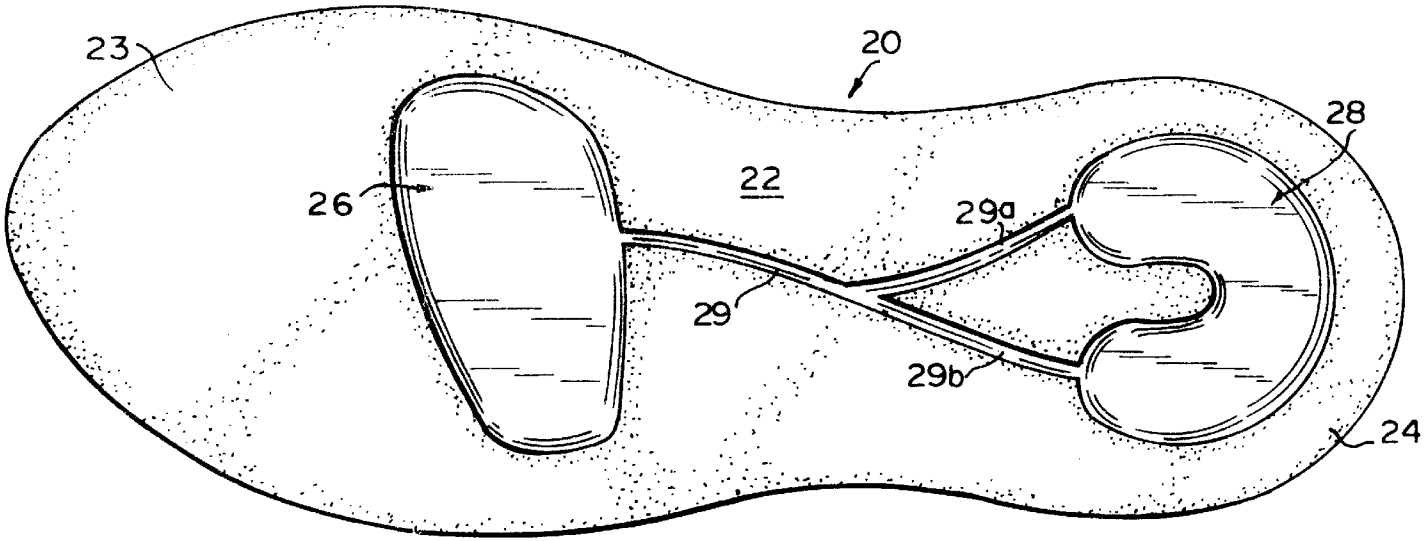
FIG. 3 is an enlarged top plan view of the outsole of the shoe sole and heel construction of FIG. 1.
Figure 4:
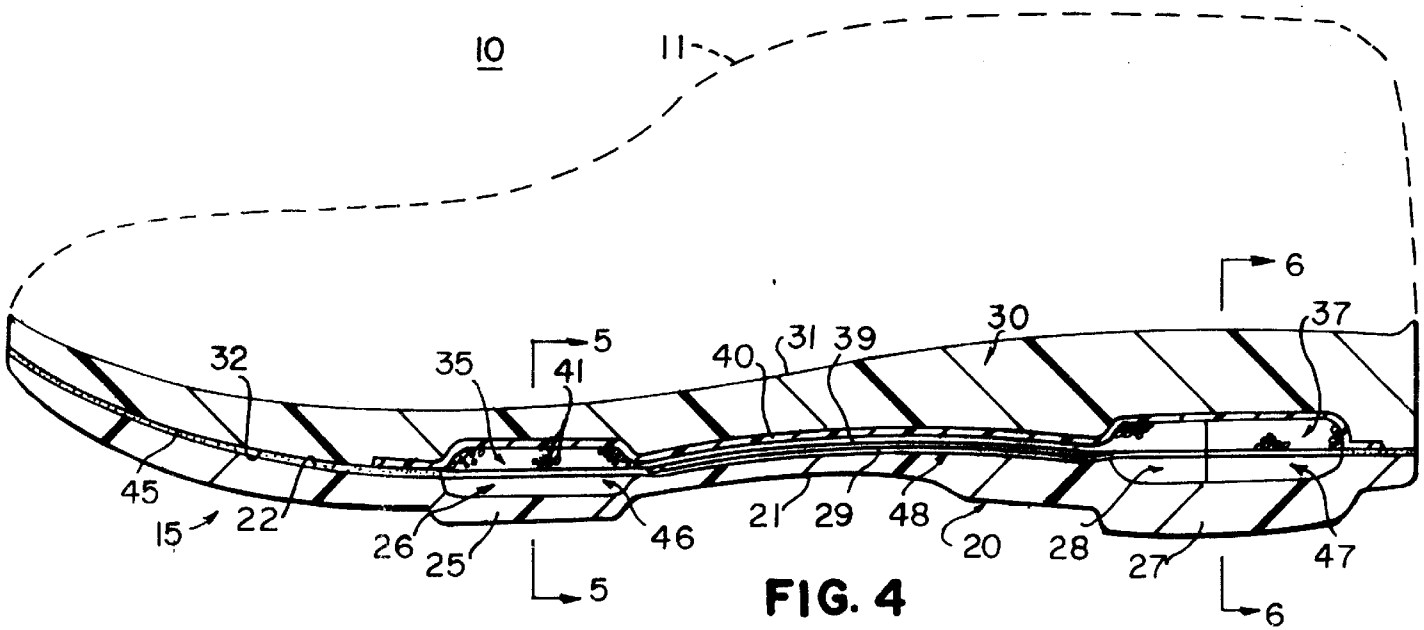
FIG. 4 is an enlarged view in longitudinal vertical section of the assembled shoe sole and heel construction of FIG. 1.

Referring now to FIGS. 1 and 4, there is illustrated a shoe 10 having an upper 11 and a shoe sole and heel construction 15, the latter being constructed in accordance with the present invention. Referring also to FIGS. 2 and 3, the shoe sole and heel construction 15 includes an outsole 20 formed of a suitable wear-resistant material and having an exterior, ground-contacting surface 21 and an interior surface 22. The outsole 20 has a metatarsal region 23 for location under the metatarsal portion of a wearer's foot, and a heel region 24 for location under the heel portion of a wearer's foot. A metatarsal bulge 25 is molded into the metatarsal region 23 and projects downwardly from the exterior surface 21 (FIG. 4). The bulge 25 defines a metatarsal cavity 26 which opens at the interior surface 22. Similarly, a generally U-shaped heel bulge 27 is molded in the heel region 24 and projects downwardly from the exterior surface 21, forming a heel cavity 28 which opens at the interior surface 22. An elongated, narrow, restricted recess 29 is also molded in the outsole 20 and opens at the interior surface 22, the recess 29 communicating with the metatarsal cavity 26 centrally of the rear edge thereof and having branches 29*a* and 29*b* which respectively communicate with the ends of the legs of the U-shaped cavity 28.

The shoe sole and heel construction 15 also includes a midsole 30 which, in use, overlies the outsole 20 substantially congruent therewith and has an upper foot-facing surface 31 and a lower outsole-facing surface 32. The midsole 30 has a metatarsal region 33 disposed for location under the metatarsal portion of a user's foot, and a heel region 34 disposed for location under the heel portion of a user's foot. Formed in the metatarsal region 33 is a metatarsal cavity 35 which opens at the outsole-facing surface 32 and defines cavity walls 36. Also formed in the heel region 34 is a generally U-shaped heel cavity 37, which opens at the outsole-facing surface 32 and defines cavity walls 38. An elongated, narrow, restricted recess 39 is also formed in the midsole 30 and opens at the outsole-facing surface 32, communicating with the metatarsal cavity 35 centrally of the rear edge thereof and having branches 39*a* and 39*b*, which, respectively, communicate with the ends of the legs of the U-shaped heel cavity 37.

The shoe sole and heel construction also includes a thin liner sheet 40 formed of a suitable plastic material, such as a thermoplastic polyurethane material, and having a plurality of perforations 41 formed therethrough spaced evenly over the entire surface of the sheet. The sheet 40 has an enlarged metatarsal region 42 and an enlarged heel region 43 joined by an elongated, narrow neck region 44. The liner sheet 40 is fixedly secured to the midsole 30 in a manner to be described more fully below, and completely lines the cavity walls 36 and 38 of the metatarsal and heel cavities 35 and 37, as well as the walls of the restricted recess 39, and also covers portions of the outsole-facing surface 32 immediately adjacent to and encompassing the cavities 35 and 37 and the recess 39, as can best be seen in FIG. 2. The perforations 41 give the liner sheet 40 a mesh-like appearance.

Figure 6:
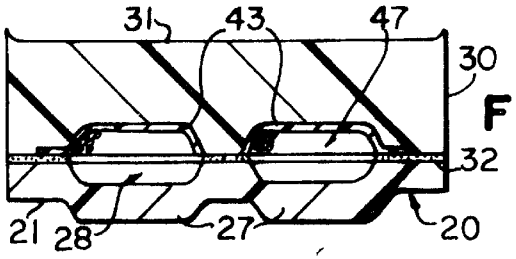
FIG. 6 is a further enlarged view in vertical section taken along the 6—6 in FIG. 4.
Figure 5:
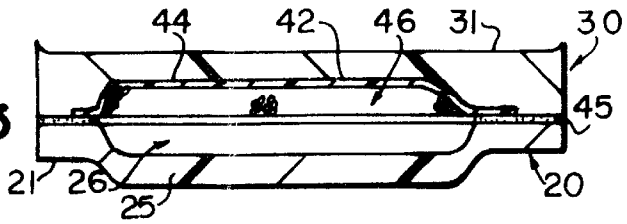
FIG. 5 is a further enlarged view in vertical section taken along the line 5—5 in FIG. 4.

In assembly, the combination of the midsole 30 and liner sheet 40 are joined to the outsole 20, as by a suitable adhesive layer 45 (FIG. 4). The midsole 30 is preferably shaped and sized to be stacked on the outsole 20 substantially congruent therewith. More specifically, the midsole cavities 35 and 37 and recess 39 are, respectively, substantially congruent with the outsole cavities 26 and 28 and restricted recess 29 in use. Thus, when the outsole-facing surface 32 of the midsole 30 is adhesively secured to the interior surface 22 of the outsole 20, the metatarsal cavity 35 of the midsole 30 cooperates with the metatarsal cavity 26 of the outsole 20 to form a metatarsal chamber 46, the heel cavity 37 of the midsole 30 cooperates with the heel cavity 28 of the outsole 20 to form a heel chamber 37, and the restricted recess 39 of the midsole 30 cooperates with the restricted recess 29 of the outsole 20 to define a restricted passageway 48, as can best be seen in FIGS. 4–6. The branched restricted passageway 48 provides communication between the metatarsal chamber 46 and the heel chamber 47. The outsole 20 and the midsole 30 are hermetically sealed together for confining air at atmospheric pressure in the chambers 46 and 47 and the restricted passageway 48. This arrangement of chambers and branched passageway functions in substantially the same manner described for the similar configuration in the aforementioned U.S. Pat. No. 5,524,364, the disclosure of which is incorporated herein by reference.

It is a significant aspect of the present invention that the liner sheet 40 serves as a stabilizing and reinforcing member which enhances the durability, strength and fluid-tightness of the completed shoe sole and heel construction 15. Thus, the liner sheet 40 serves to evenly distribute pressure across the regions of the chambers 35 and 37 and the restricted passageway 39. This spreading or distribution of the forces applied by the user's foot tends to equalize pressures and minimize the occurrence of large local pressure buildups, which may tend to increase leakage of air through the material of the midsole 30 or from the seam between the midsole 30 and outsole 20. Furthermore, this pressure equalization serves to minimize the occurrence of any discomfort to the user's foot in use, even in the event of relatively thin midsoles.

Figure 8:
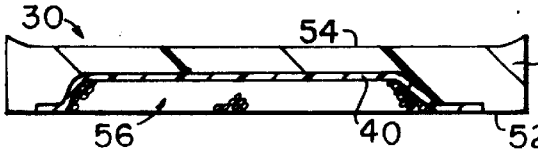
FIG. 8 is a view of the completed midsole after molding.
Figure 7:
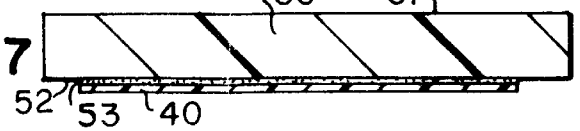
FIG. 7 is a view in vertical section of a midsole form with a liner sheet adhered thereto prior to molding of the midsole.

Referring now also to FIGS. 7 and 8 of the drawings, there is illustrated a preferred method of forming the assembly of the midsole 30 and liner sheet 40. Initially, a block or body 50 of midsole material is provided generally in the shape and size of the outline of the finished shoe sole and heel construction, the body 50 having an upper surface 51 and a lower surface 52. The body 50 may be formed of a suitable plastic material, preferably a porous or somewhat "spongy," moldable material, such as EVA. The pre-cut liner sheet 40 is positioned on the lower surface 52 of the body 50 for covering what will become the metatarsal and heel regions thereof, and is secured thereto, as by an adhesive 53. Then the combination of the body 50 and liner sheet 40 is compression molded to form the finished midsole 30, which may have a shallow recess 54 in the upper surface 51 to fit to a user's foot, and a cavity formation 56, which includes the cavities 35 and 37 and the restricted recess 39 (only one cavity shown), formed in the lower surface 52, which becomes the outsole-facing surface 32. This cavity formation 56 is lined by the liner sheet 40, which has been deformed in the molding operation simultaneously with the forming of the cavity formation 56, the molding operation also compressing the liner sheet 40 together with the body 50 and permanently securing the parts together.

It would also be possible to adhesively secure the liner sheet 40 to the midsole 30 after molding thereof, but this would be a more expensive and time consuming operation.

While, in the illustrated embodiment, the shoe sole and heel construction 15 has metatarsal and heel chambers 46 and 47 joined by a restricted passageway 48, the liner sheet of the present invention could also be used in configurations which did not include the restricted passageway 48. Also, while the restricted passageway 48 has been disclosed as being formed partially by a recess in the midsole 30 and partially by a recess in the outsole 20, it could be formed entirely by a recess in the midsole. Similarly, while the chambers 46 and 47 have been illustrated as being formed partially by cavities in the midsole and partially by cavities in the outsole, they could be formed solely by cavities in the midsole, with the interior surface 22 of the outsole 20 remaining flat.

In a preferred embodiment of the liner sheet 40, it is a perforated or mesh-like sheet, but it could also be formed of an imperforate sheet. Also, while a thermoplastic polyurethane material is preferred for the liner sheet 40, it will be appreciated that other plastic materials might be used, such as PVC, vinyl and the like.

From the foregoing, it can be seen that there has been provided an improved shoe sole and heel construction, which has fluid-filled chambers formed at least in part in a midsole portion thereof, the chambers being lined along the midsole portion thereof by a liner sheet which affords improved stability, load distribution and leak protection.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A shoe sole and heel construction comprising: an outsole having interior and exterior surfaces, a midsole having an outsole-facing surface and a foot-facing surface, said midsole having a cavity formation therein opening at said outsole-facing surface and defining cavity wall surfaces, a liner sheet contacting and covering said cavity wall surfaces and a portion of said outsole-facing surface immediately adjacent to said cavity formation, means securing said outsole-facing surface of said midsole to said interior surface of said outsole in substantially fluid-tight manner so that said outsole cooperates with a lined midsole cavity formation to define therebetween a substantially fluid-tight chamber formation, and fluid confined in said chamber formation.

2. The shoe sole and heel construction of claim 1, wherein said liner sheet is perforated to form a mesh-like structure.

3. The shoe sole and heel construction of claim 1, wherein said liner sheet is formed of a polyurethane material.

4. The shoe sole and heel construction of claim 3, wherein said liner sheet is perforated to form a mesh-like structure.

5. The shoe sole and heel construction of claim 1, wherein said midsole includes a metatarsal region and a heel region, said cavity formation including a metatarsal cavity formed in said metatarsal region and a heel cavity formed in said heel region.

6. The shoe sole and heel construction of claim 5, wherein said liner sheet extends between said heel cavity and said metatarsal cavity.

7. The shoe sole and heel construction of claim 5, wherein said cavity formation further includes a restricted passageway communicating with said metatarsal cavity and said heel cavity.

8. The shoe sole and heel construction of claim 1, wherein said outsole is adhesively secured to said midsole.

9. The shoe sole and heel construction of claim 1, wherein said fluid is air at atmospheric pressure.

10. A shoe sole and heel construction comprising: an outsole having interior and exterior surfaces, said outsole including bulge structure projecting from said exterior surface and defining an outsole cavity formation opening at said interior surface, a midsole having an outsole-facing surface and foot-facing surface, said midsole having a midsole cavity formation therein opening at said outsole-facing surface and defining midsole cavity wall surfaces, a liner sheet contacting and covering said midsole cavity wall surfaces and a portion of said outsole-facing surface immediately adjacent to said midsole cavity formation, means securing said outsole-facing surface of said midsole to said interior surface of said outsole in substantially fluid-tight manner so that said outsole cavity formation cooperates with a lined midsole cavity formation to define therebetween a substantially fluid-tight chamber formation and, fluid confined in said chamber formation.

11. The shoe sole and heel construction of claim 10, wherein said midsole cavity formation is substantially congruent with said outsole cavity formation.

12. The shoe sole and heel construction of claim 11, wherein said midsole includes a metatarsal region and a heel region, said midsole cavity formation including a metatarsal cavity formed in said metatarsal region and a heel cavity formed in said heel region.

13. The shoe sole and heel construction of claim 12, wherein said liner sheet extends between said heel cavity and said metatarsal cavity.

14. The shoe sole and heel construction of claim 13, and further comprising a restricted passageway communicating with said metatarsal chamber and said heel chamber.

15. The shoe sole and heel construction of claim 10, wherein said liner sheet is perforated to form a mesh-like structure.

16. The shoe sole and heel construction of claim 10, wherein said liner sheet is formed of a polyurethane material.

17. The shoe sole and heel construction of claim 10, wherein said outsole is adhesively secured to said midsole.

* * * * *